US009719306B2

(12) United States Patent
Seppala et al.

(10) Patent No.: US 9,719,306 B2
(45) Date of Patent: Aug. 1, 2017

(54) DRILL BIT FOR A PERCUSSIVE HAMMER AND SHANK THEREFORE

(71) Applicant: SANDVIK INTELLECTUAL PROPERTY AB, Sandviken (SE)

(72) Inventors: Conny Seppala, Gavle (SE); Tomas Sh Jansson, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 350 days.

(21) Appl. No.: 14/371,017

(22) PCT Filed: Dec. 7, 2012

(86) PCT No.: PCT/EP2012/074791
§ 371 (c)(1),
(2) Date: Jul. 8, 2014

(87) PCT Pub. No.: WO2013/104470
PCT Pub. Date: Jul. 18, 2013

(65) Prior Publication Data

US 2014/0345953 A1 Nov. 27, 2014

(30) Foreign Application Priority Data

Jan. 9, 2012 (EP) ..... 12150466

(51) Int. Cl.
*E21B 10/36* (2006.01)
*E21B 17/07* (2006.01)

(52) U.S. Cl.
CPC ..... *E21B 10/36* (2013.01); *E21B 17/076* (2013.01)

(58) Field of Classification Search
CPC ..... E21B 10/36; E21B 17/076
See application file for complete search history.

(56) References Cited

U.S. PATENT DOCUMENTS

| | | | | |
|---|---|---|---|---|
| 2,608,180 | A * | 8/1952 | Curtis | E21C 3/24 173/132 |
| 4,862,976 | A * | 9/1989 | Meek | E21B 4/06 175/296 |
| 5,065,827 | A * | 11/1991 | Meyers | E21B 4/14 175/293 |
| 5,704,744 | A | 1/1998 | Kleine | |
| 5,984,596 | A | 11/1999 | Fehrle | |
| 6,938,710 | B2 | 9/2005 | Simmons | |
| 8,985,245 | B2 * | 3/2015 | Purcell | E21B 17/0426 175/414 |
| 2004/0065482 | A1 * | 4/2004 | Larsson | E21B 10/36 175/414 |
| 2004/0188146 | A1 | 9/2004 | Egerstrom | |
| 2007/0007045 | A1 | 1/2007 | Lorger et al. | |

(Continued)

FOREIGN PATENT DOCUMENTS

| | | |
|---|---|---|
| AU | 2006203631 | 8/2006 |
| CN | 102282334 A | 12/2011 |

(Continued)

*Primary Examiner* — Shane Bomar
(74) *Attorney, Agent, or Firm* — Corinne R. Gorski

(57) ABSTRACT

A bit for a percussive hammer includes an elongated shank, a head at a first end of the shank, and an array of lengthwise extending spline portions defining outwardly extending retention lugs at or toward a further end of the shank. At least a side face of at least one lug is blended into the shank of the bit.

7 Claims, 4 Drawing Sheets

(56) References Cited

U.S. PATENT DOCUMENTS

| | | | | |
|---|---|---|---|---|
| 2007/0089908 | A1 | 4/2007 | Underwood | |
| 2007/0137895 | A1 | 6/2007 | Marshall et al. | |
| 2008/0135304 | A1 | 6/2008 | Duggan et al. | |
| 2010/0175928 | A1* | 7/2010 | Lee | E21B 10/36 175/414 |
| 2010/0252330 | A1* | 10/2010 | Gilbert | E21B 4/06 175/293 |

FOREIGN PATENT DOCUMENTS

| | | | |
|---|---|---|---|
| EP | 1508391 | A2 | 2/2005 |
| GB | 1264016 | | 2/1972 |
| WO | 9858153 | A1 | 12/1998 |
| WO | 2007010513 | | 1/2007 |
| WO | 2009023930 | A1 | 2/2009 |

* cited by examiner

DRILL BIT FOR A PERCUSSIVE HAMMER AND SHANK THEREFORE

RELATED APPLICATION DATA

This application is a §371 National Stage Application of PCT International Application No. PCT/EP2012/074791 filed Dec. 7, 2012 claiming priority of EP Application No. 12150466.6, filed Jan. 9, 2012.

A drill bit for a percussive hammer is typically mounted in the drive sub beneath the piston by bit retention means in the form of a bit retaining ring (or bit ring).

Accordingly, the bit typically comprises an elongate shank, a head at a first end of the shank, and an array of lengthwise extending spline portions defining outwardly extending retention lugs at or toward a further end of the shank which are configured to rest on the bit ring so as to limit the travel of the bit and retain this in the drive sub. The head typically has buttons protruding from a steel body defining the cutting face of the bit.

Failure of the retention lugs resulting from high cyclic loading during hammer operation is a significant problem which can result in loss of the bit in the hole being drilled.

In U.S. Pat. No. 4,862,976 there is disclosed a bit having retention lugs 62 which have been strengthened by oversizing.

In U.S. Pat. No. 3,918,538 there is disclosed a bit having retention lugs 11, each lug comprising a forward face which meets the shank of the bit with a very small radius, but otherwise incorporating stress concentration points common to retention lugs of bits of the prior art.

In US 2007/0137895 there is disclosed a drill bit for percussive drilling with a plurality of splines on the longitudinal surface, which splines are arranged on the shank of the drill bit.

It is against this background that the problems and difficulties associated therewith that the present invention has been developed.

Other objects and advantages of the present invention will become apparent from the following description, taken in connection with the accompanying drawings, wherein, by way of illustration and example, an embodiment of the present invention is disclosed.

In one aspect, the invention may be said to reside in a bit for a percussive hammer comprising an elongated shank, a head at a first end of the shank, and an array of lengthwise extending spline portions defining outwardly extending retention lugs at or toward a further end of the shank. At least a side face of at least one lug is blended into the shank of the bit. The bit comprises a further array of lengthwise extending spline portions longitudinally spaced from the array of lugs toward the head end of the bit, each of the further spline portions having a top land, which is perceptibly wider than the top land of each lug.

In the context of the present application the term 'blended' should be taken to mean that a line of demarcation between the surfaces said to be blended cannot be distinguished.

In one form, the lugs are configured to rest on a bit ring so as to limit the travel of the bit and retain this in a drive sub.

In one form, the or each lug comprises a pair of side faces, each of which is blended into the shank of the bit.

In one form, the or each lug comprises first and second end faces, and the bit is further characterised in that at least one of these end faces is blended into the shank of the bit.

In one form, each of the end faces of the or each lug is blended into the shank of the bit.

In one form, the or each lug comprises a top land, and the bit is further characterised in that at least one of the end faces of the lug is blended into the top land of the lug.

In one form, each of the end faces of the or each lug is blended into the top land of the lug.

In one form, each lug face blended into the shank is so blended by way of a concave easing or fillet extending between the face and the shank.

In one form, the concave easing or fillet of each side face is perceptibly wider than the top land of each lug.

In one form, the or each lug end face blended in to the top land of the lug is so blended by way of a convex easing or round extending between the face and the top land.

In one form, a concave easing or fillet further blends into a convex easing or round. Such a multi-stage blend may be employed to blend a top face of the lug into the shank.

In one form, the bit comprises a further array of lengthwise extending spline portions longitudinally spaced from the first array toward the head end of the bit, each of the further spline portions having a top land which is perceptibly wider than the top land of each lug.

In one form, extending between each side wall of spline portions in the further array and the shank is a concave fillet having a radius or curvature which is perceptibly smaller than the fillet extending between each of the side walls of the lugs and the shank.

In one form, the fillets extending between side walls of the lugs and the shank have a radius which is two or more times greater than a radius of fillets extending between side walls of spline portions in the further array and the shank. That is to say, a ratio of fillet radii of 2:1 or more.

In one form, this ratio of fillet radii is in the range of 3:1 and 8:1.

In one form, each blended lug face is blended into a bottom land between adjacent lugs.

In a further aspect, the invention may be said to reside in a shank of a drill bit for a percussive hammer comprising a head at a first end of the shank, said shank comprising an array of lengthwise extending spline portions defining outwardly extending retention lugs at or toward a further end of the shank. At least a side face of at least one lug is blended into the shank. The shank comprises a further array of lengthwise extending spline portions longitudinally spaced from the array of lugs toward the head at a first end of the shank, each of the further spline portions having a top land which is perceptibly wider than the top land of each lug.

In one form, the number of lugs is not equal to the number of further spline portions.

In one form, the number of lugs is less than the number of further spline portions.

In a further aspect, the invention may be said to reside in a percussive hammer comprising a bit as described above.

BRIEF DESCRIPTION OF THE DRAWINGS

For a better understanding of this disclosure it will now be described with respect to one or more exemplary embodiments, which shall be described herein with the assistance of drawings wherein.

In the following description, like reference characters designate like or corresponding parts throughout the several views of the drawings.

DESCRIPTION OF A PREFERRED EMBODIMENT

Figure 1:
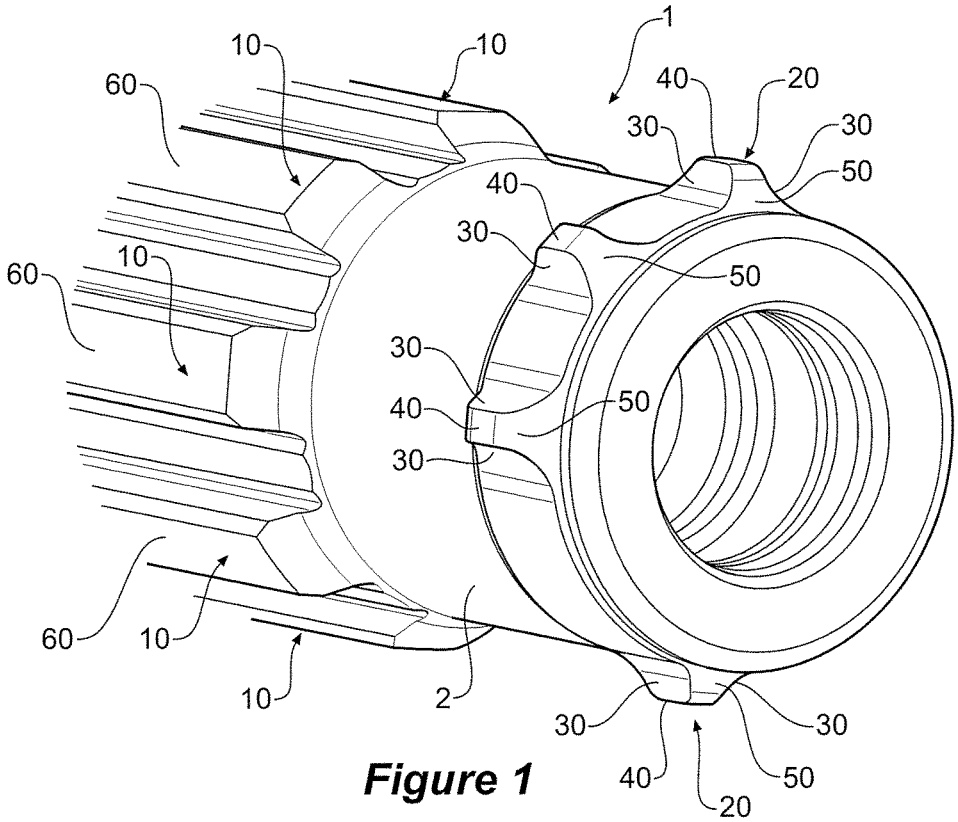
FIG. 1 is a perspective view of an end of a bit for a percussive hammer according to an exemplary embodiment of the present invention.
Figure 2:
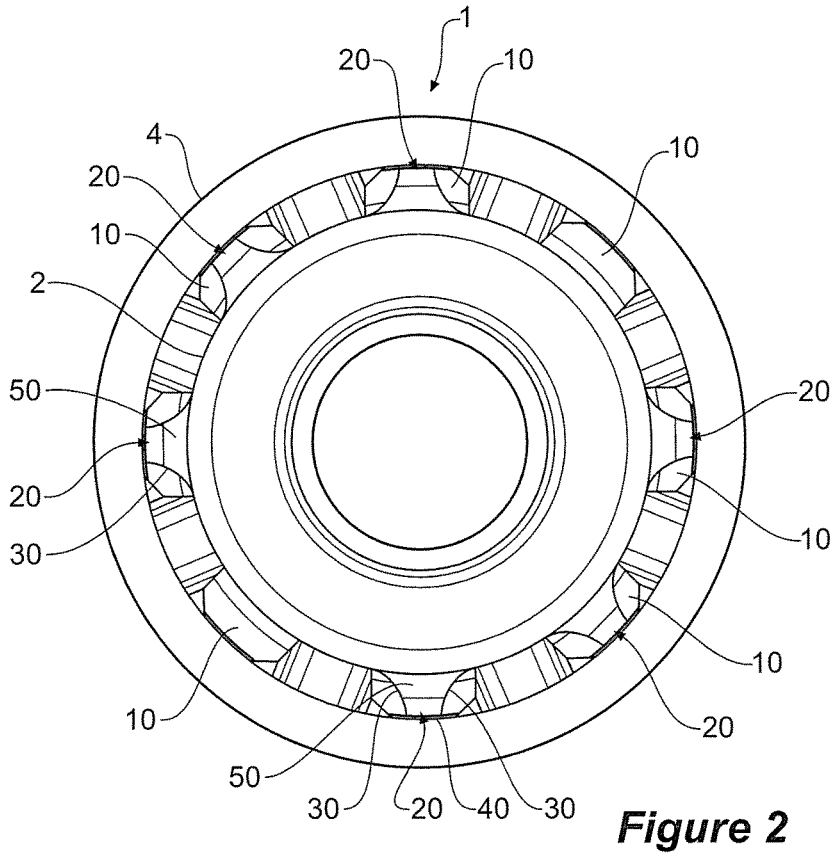
FIG. 2 is an end view of the bit end illustrated in FIG. 1.
Figure 3:
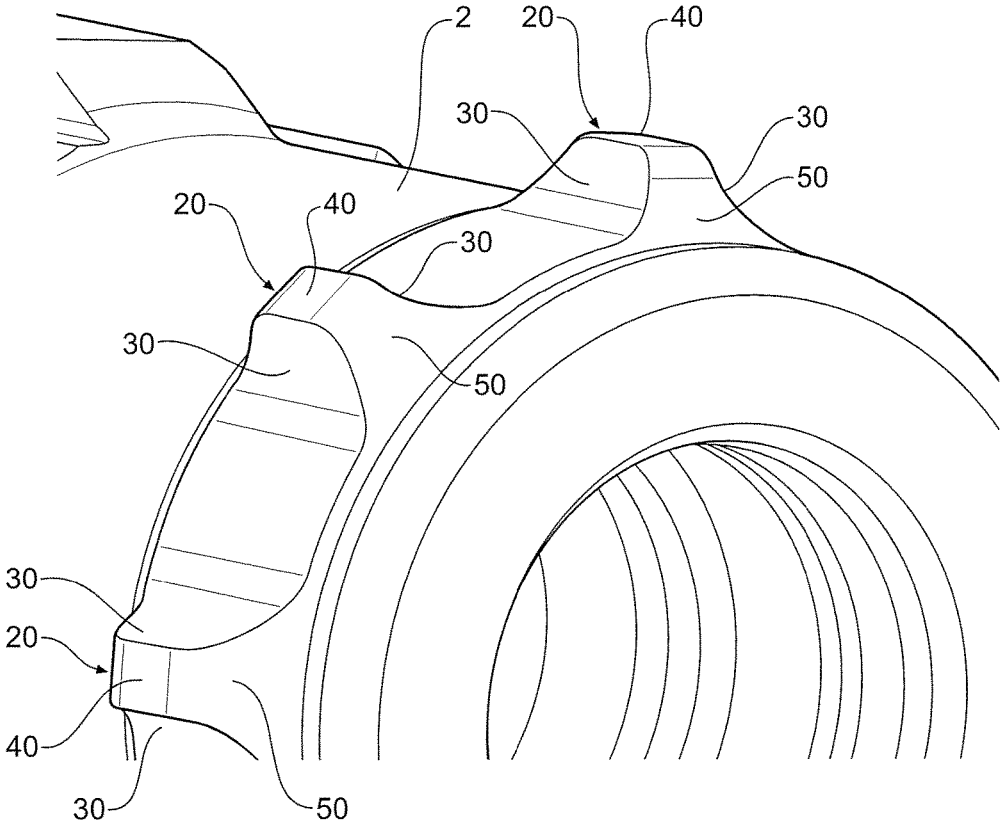
FIGS. 3 and 4 are detail perspective views of retention lugs from the bit end illustrated in FIG. 1.
Figure 4:
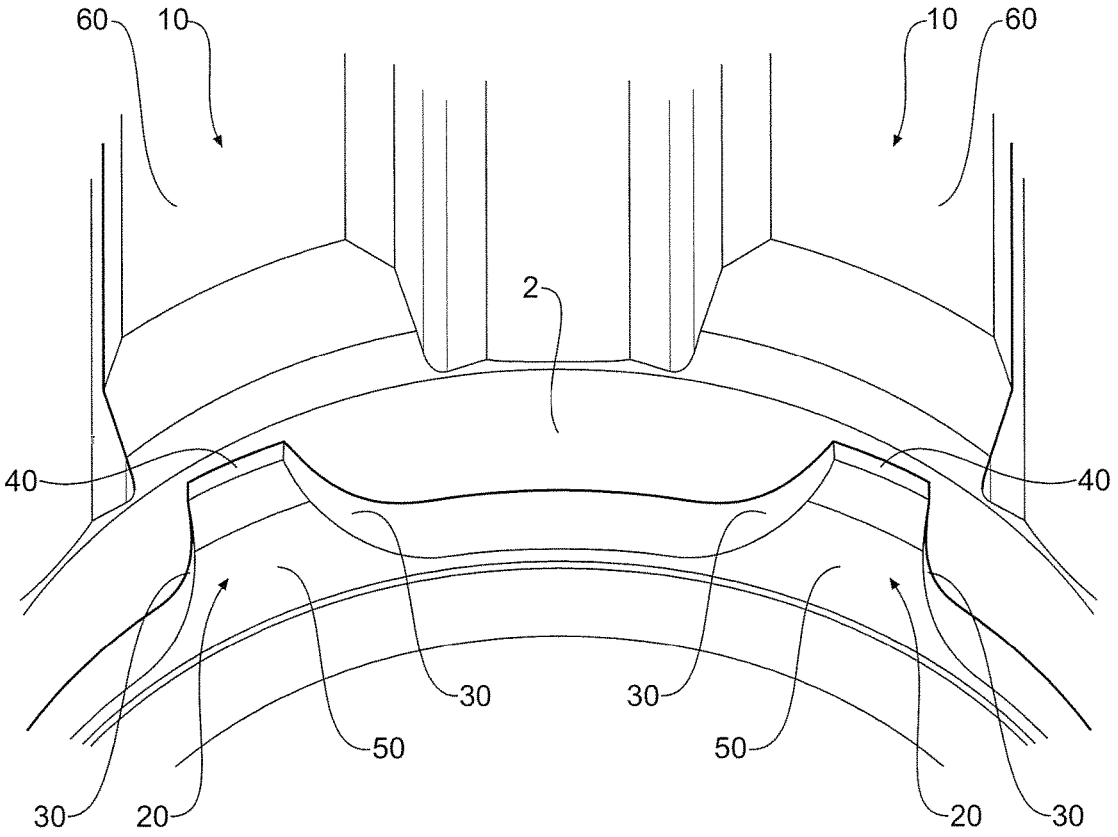
Figure 5:
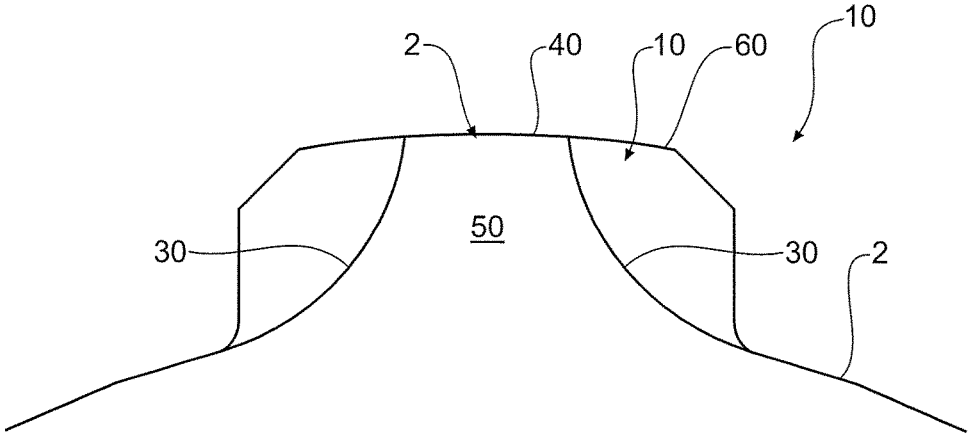
FIG. 5 is a detail end view of a retention lug from the bit end illustrated in FIG. 1.

Referring now to the Figures, where there is illustrated a drill bit 1 for a percussive hammer having either a normal (DTH) or reverse circulation (RC) system comprising a cylindrical case (not illustrated), and a drive sub (not illustrated) threadably mounted in the case. A piston (not illustrated) will be vertically reciprocally mounted in the case to be reciprocated by pressurised air. The drill bit 1 is mounted in the drive sub beneath the piston by bit retention means in the form of a bit retaining ring (or bit ring).

The drive sub comprises an annular sleeve with an array of spaced apart, inwardly directed driving splines.

The drill bit 1 comprises a shank 2 and a drill bit head 4 with a bit face. The shank 2 has a number of outwardly directed driven splines 10, which are so spaced and numbered as to form, with the driving splines on the drive sub, pairs of splines having abutting working faces when the shank 2 of the drill bit 1 is inserted into the drive sub.

In use, the driving splines act against the driven splines 10 to drive rotation of the drill bit 1 while permitting the drill bit 1 to move longitudinally (under the effect of the hammer), with respect to the drive sub.

Thus, rotation is transmitted to the case by means of the drill string (not illustrated), and the bit 1 is thus driven in rotation by the drive sub while being impacted upon by the piston.

The bit 1 further comprises an array of lengthwise extending spline portions defining outwardly extending retention lugs 20 at or toward a further end (i.e. distal the head 4 end) of the shank 2, and longitudinally spaced from the driven splines 10 by a splineless portion of the shank 2.

In use the lugs 20 are configured to rest on the bit ring so as to limit the travel of the bit 1 and retain this in the drive sub.

Each lug 20 comprises a pair of side faces 30, each of which is blended into the shank 2 of the bit by way of a single and continuous concave easing or fillet extending between the edge of the top land 40 and the shank 2, which is perceptibly wider than a top land 40 of each lug 20.

Each lug 20 further comprises first and second end faces 50, each of which is blended into the shank 2 of the bit 1 by way of a convex easing or round extending between the face 50 and the top land 40.

Blending the side and/or end faces of the lugs 20 into the shank 2 of the bit 1 in the fashion described herein eliminates some of the stress concentration points also known as initiation points or stress raisers found on the lugs of many of the bits of the prior art, and from which fatigue cracks tend to propagate.

Accordingly, the lugs 20 of the bit 1 according to the present invention are more durable and capable of bearing larger loads than are the lugs of many of the bits of the prior art. As a result, less of these lugs 20 may be required than would be lugs of the prior art.

The present invention can be regarded as an optimization of the shank close to the striking face of a drill bit. The main purpose and effect of the present invention is to avoid high stresses in such a critical area of a drill bit. Another advantage may be to minimize crack initiation points by reducing the number of lugs 20.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

The disclosures in EP Patent Application No. 12150466.6, from which this application claims priority, are incorporated herein by reference.

The invention claimed is:

1. A drill bit for a percussive hammer comprising:

an elongated shank having opposed ends;

a head disposed at a first end of the shank;

an array of lengthwise extending spline portions defining outwardly extending retention lugs at or toward a second end of the shank, each of the retention lugs having opposed side faces, a top land and first and second end faces, at least one side face of at least one lug of the retention splines being blended into the shank of the bit, and each of the first and second end faces of each retention lug is blended into the top land; and a plurality of lengthwise extending driven splines longitudinally spaced from the array of retention lugs located toward the head end of the bit, each of the driven splines having a top land perceptibly wider than the top land of each lug of the retention splines.

2. The bit of claim 1, wherein each retention lug of the spline portions includes a pair of side faces, each of the side faces being blended into the shank of the bit.

3. The bit of claim 1, wherein each of the first and second end faces of each retention lug of the spline portions is blended into the shank of the bit.

4. The bit of claim 3, wherein each retention lug face blended into the shank is blended by a single and continuous concave easing or fillet extending between an edge of the top land and the shank.

5. The bit of claim 4, wherein the concave easing or fillet of each side face is perceptibly wider than the top land of each retention lug.

6. The bit of claim 1, wherein each of the first and second retention lug end faces blended into the top land of the retention lug is blended by a convex easing or round extending between the face and the top land.

7. A shank of a drill bit for a percussive hammer having a head at a first end of the shank, said shank comprising:

an array of lengthwise extending spline portions defining outwardly extending retention lugs at or toward a further end of the shank, each of the retention lugs having opposed side faces, a top land and first and second end faces, at least one side face of at least one retention lug of the spline portions blending into the shank and each of the first and second end faces of each retention lug being blended into the top land; and a plurality of lengthwise extending driven splines longitudinally spaced from the array of spline portions disposed toward the head at a first end of the shank, each of the driven spline having a top land which is perceptibly wider than the top land of each retention lug.

* * * * *